United States Patent [19]

Blanchet

[11] 4,015,889

[45] Apr. 5, 1977

[54] SHUNT FOR PROVIDING A DIRECT ELECTRICAL CONNECTION

[75] Inventor: Lucien Blanchet, Le Vesinet, France

[73] Assignee: Air LB, Colombes, France

[22] Filed: Oct. 20, 1975

[21] Appl. No.: 624,059

[30] Foreign Application Priority Data

Nov. 12, 1974 France ..... 74.37278

[52] U.S. Cl. ..... 339/19; 339/91 R; 339/258 P

[51] Int. Cl.[2] ..... H01R 13/12; H01R 31/08

[58] Field of Search ..... 339/18, 19, 222, 205, 339/198 R, 198 P, 198 S, 242, 256 R, 258 R, 258 P, 91 R

[56] References Cited

UNITED STATES PATENTS

| | | | |
|---|---|---|---|
| 3,175,179 | 3/1965 | Trump | 339/18 C |
| 3,209,310 | 9/1965 | Schwartz et al. | 339/258 P |
| 3,560,911 | 2/1971 | Zimmerman, Jr. et al. | 339/258 P |
| 3,605,078 | 9/1971 | Paullus | 339/259 |

*Primary Examiner*—Roy Lake
*Assistant Examiner*—Neil Abrams
*Attorney, Agent, or Firm*—Brisebois & Kruger

[57] ABSTRACT

Device for providing a direct electrical connection between the male terminal plugs of a plurality of cables comprises an elongated metallic member shaped to form at least one channel, one side of said channel being formed with resilient tabs which engage the ends of said plugs to make electrical contact therewith.

3 Claims, 3 Drawing Figures

SHUNT FOR PROVIDING A DIRECT ELECTRICAL CONNECTION

SUMMARY OF THE INVENTION

It is conventional to use for the electrical connection of male plugs at the ends of cables, female sockets having stamped tongues at their upper ends which are adapted to lock the male plugs by catching behind collars on these male plugs, and comprising at their other ends female members shaped to cooperate elastically, either directly or indirectly, with the front parts of the male plugs in front of said locking collars, said female members also comprising at their central part a riveting orifice on a metallic shunt member which is customarily flat.

However, the manufacture of such individual female sockets and the riveting of each of these sockets to a connecting shunt results in a relatively high price in view of the relative complexity of the female sockets which comprise two superposed series of resilient contacts adapted to respectively provide an electrical connection between the male plug and the female socket and lock these male plugs behind their collars.

The present invention relates to a shunt device made from an elongated shaped member having at least one concave part having a depth clearly greater than the height of the rear part of said male plugs. These elongated metallic members, which define at least one channel having substantially vertical walls and are preferably made so as to form two juxtaposed channels are provided from point to point with means for electrically connecting them to the cylindrical front parts of said male plugs. When using an elongated member defining a single channel, the electrical connecting members comprise, on the opposite sides of said single trough, elastic strips made by stamping them from the elastic metal such as cupro-beryllium, from which the elongated members are made.

In the most usual case, in which one begins with an elongated member defining two juxtaposed channels, it is not possible to easily form elastic tongues acting as springs on the vertical internal walls of said groove, by puncturing the metal of said elongated member.

In this case, the internal walls are provided with stamped bosses without puncturing the metal of this shaped member, these bosses being grouped in pairs so as to permit the introduction of the male plugs between the two bosses of each pair, a satisfactory electrical contact being obtained by means of elastic tongues produced by puncturing the vertical external walls of those elongated members having two parallel channels.

In this embodiment, the male plugs are locked in by means of independent cylindrical sleeves made from cylindrical tubes and comprising pairs of elastic tabs capable of exerting a sufficient pressure on opposite sides of said male plugs to ensure their retention, the ends of said elastic tabs bearing on the periphery of the plugs at a short distance from the top of the collar, the lower part of which may descend to the level of said locking sleeves In an improved method of carrying out the present invention the locking sleeves are provided with a slight conicity in order to improve their retention inside the synthetic insulating material constituting the sealed connecting modules.

This conicity is preferably obtained by stamping at the same time that the elastic locking tongues are stamped out.

These locking sleeves are then introduced through the lower part of said modules before the introduction of the said shaped shunting member.

When an elongated member defining two channels is used, this member may be divided by simple longitudinal splitting into two members, each comprising a single channel, just as, depending upon the number of male plugs which are to be electrically connected together, the elongated members may be split at an equal distance from said external elastic ends and the planes of symmetry of the pairs of bosses opposite these elastic tongues.

It is thus possible to provide any number of male plugs grouped along a single line or in two parallel lines.

It goes without saying that it is equally possible to provide modules capable of receiving either two shunts having a pair of channels or a single shunt having a pair of channels and a shunt having a single channel, the latter being formed as has been described above by splitting a member having a double groove.

Or course these shunt members are held in position by means of an insulating cover which blocks a lower orifice provided on the modules of insulating material, said cover being held on the lower part of the modules by any suitable means.

The characteristics of the present invention will be better understood by a reading of the following description of one embodiment of the sealed connecting module which may receive six male plugs and utilizes a member having two channels of the type envisaged, an embodiment which is given purely by way of illustration and example, and described with reference to the accompanying drawings, on which:

Figure 1:
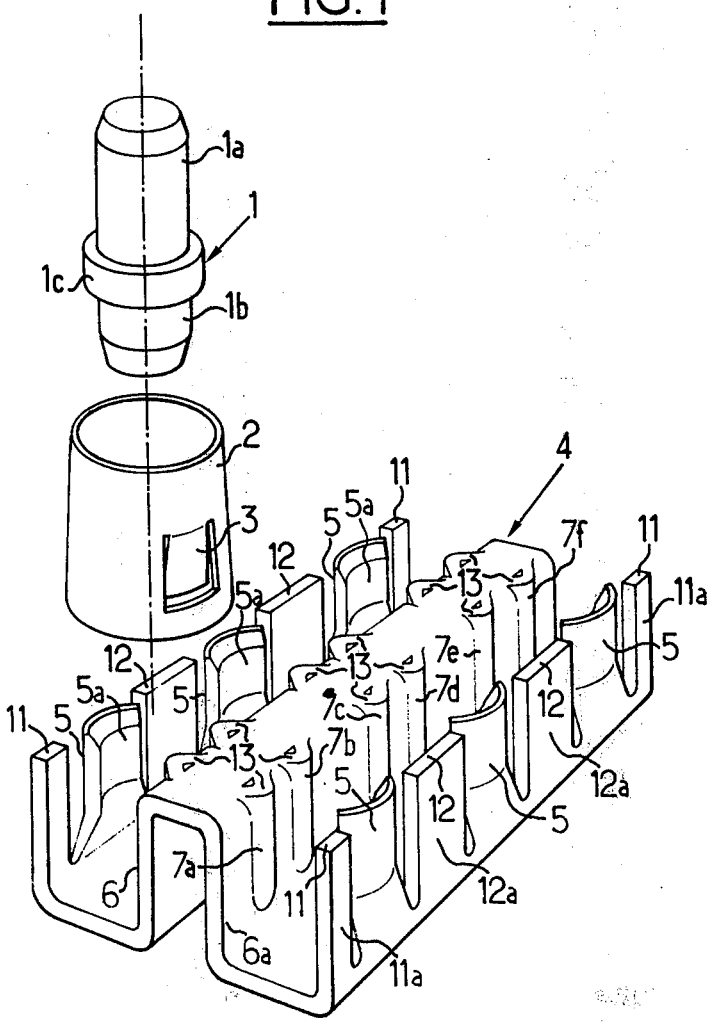
FIG. 1 is an exploded perspective view showing separately a male end plug of an electric conductor, a locking sleeve for said male plug, and a member having two channels and comprising at its central part six series of two bosses and, on each of its sides, two series of three elastic tongues which make electrical contact with said male plugs.

FIG. 1 shows a male plug 1 adapted to pass through a locking sleeve 2 provided with a pair of elastic tongues 3 obtained by puncturing of a metal such as cupro-beryllium for example. The tongues 3 are adapted to frictionally engage the periphery of the upper part 1*a* of the male plug 1 when this plug and its locking sleeve are fixed in position inside the body of a module of insulating material, after location of a shunt member 4 adapted to cooperate directly with the lower parts 1*b* of said plug 1 after passage of the median collars 1*c* of said plugs beyond the tongues 3 and the abutment of this collar against the upper edge of the member 4.

The member 4 has two channels, visible in particular on FIG. 1, and comprises, as has already been said, on its external wall, elastic tongues 5 which are so shaped that their substantially cylindrical inner walls 5*a* cooperate frictionally with the front cylindrical parts 1*b* of the male plugs.

Figure 2:
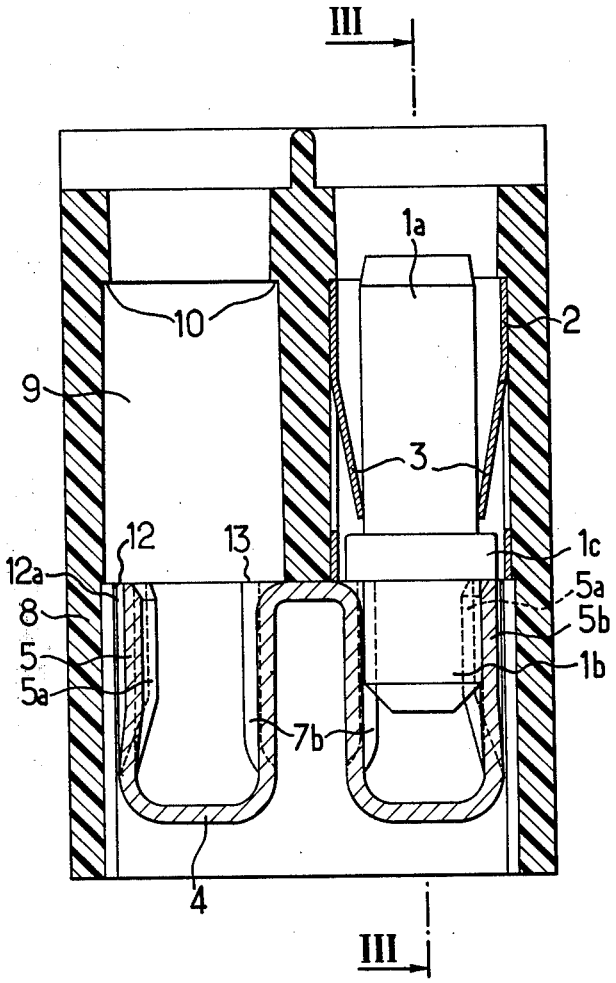
FIG. 2 is a transverse sectional view taken through the body of a module along the line II—II of FIG. 3, passing through the axes of two adjacent male plugs, and showing the respective positions of such a plug, its locking sleeve, and a member defining two channels with respect to the walls and the longitudinal median partition of said module body.
Figure 3:
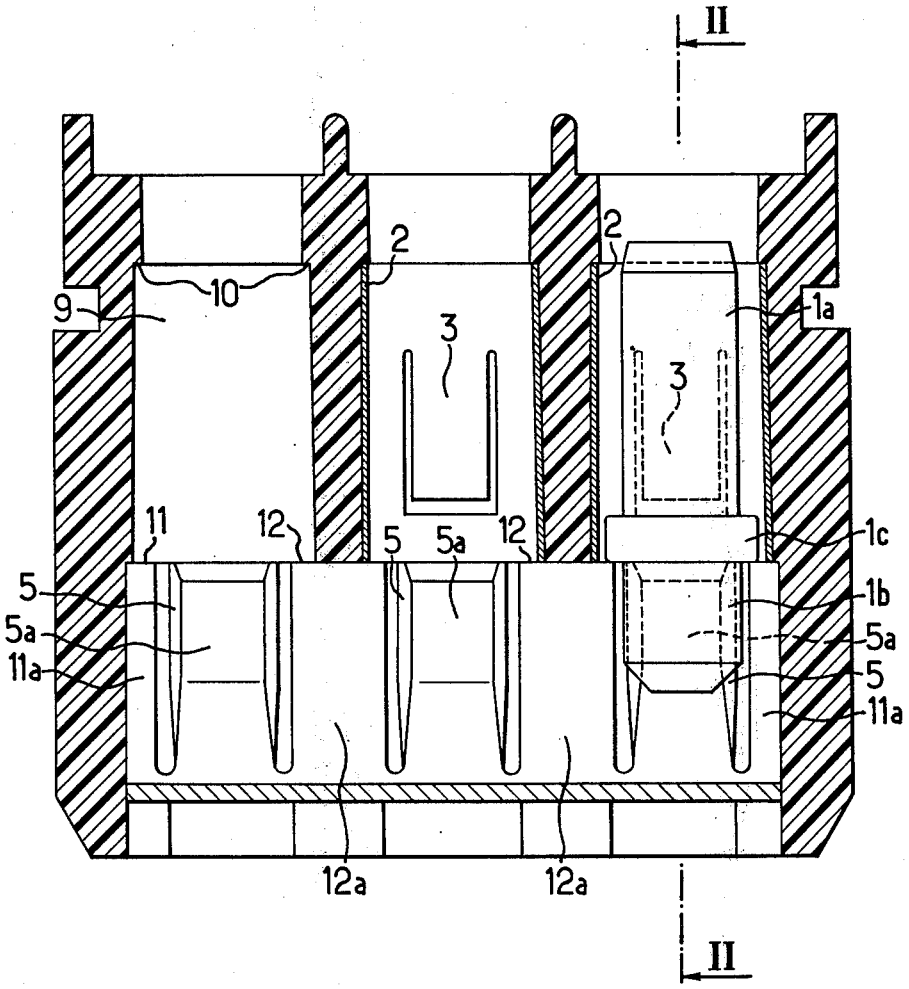
FIG. 3 is a longitudinal section taken through said module body along the line III—III of FIG. 2, passing through the axes of three adjacent male plugs cooperating with one of the channels of said shaped member.

Of course, the member 4 may cooperate with six male plugs such as the plug 1, and with six locking sleeves 2 resting at their lower ends on the upper edge of said member 4, as may be best seen on FIGS. 2 and 3.

The vertical internal walls 6 and 6*a* of the member 4 are provided with pairs of bosses 7*a*, 7*b*, – 7*e*, 7*f*, obtained by stamping metal without puncturing it, and against which the lower parts 1*b*, of six male plugs are urged when they are respectively subjected to the pressure of the six tongues 5 provided in the vertical external walls of the shunt member 4.

Referring now to FIG. 2, it will be seen, firstly, that the recesses formed in the upper part of the insulating supports of the modules 8 for receiving the sleeves 2, one of which is visible at 9 on FIG. 2, decrease in section toward the top and have at their upper ends retaining shoulders 10 preventing these sleeves from being pulled out. These slightly conical sleeves 2 are introduced from the bottom into the recesses 9 and are then supported by the upper edges 11 and 12 of the vertical external parts of the member 4 and by the upper edges 13 of the bosses 7*a* – 7*f* on which the collars 1*c* of the plugs also bear.

The lower part 1*b* of the plug 1 which is illustrated is seated between the first pair of bosses 7*a*, 7*b*, and presses the corresponding elastic tongue outwardly into the position 5*b* shown at the right of FIG. 2.

As has already been said, the member 4 is held stationary by a lower insulating cover which closes the bottom of the module and which may also comprise in a conventional manner snap fasteners for attaching it to an assembly rail.

The tongue 5*b* shown in section on FIG. 2 is shown in the position occupied by this tongue after introduction of a plug 1, while the broken lines show the back of this tongue which lies behind the part 1*b* of plug 1.

If the longitudinal section of FIG. 3 is now examined, it will be found that it shows recesses 9 of decreasing section formed in the module, the locking sleeves 2, provided with locking tongues 3, being shown in broken lines at the right of FIG. 3 behind the upper part 1*a* of the plug 1. FIG. 3 also shows at its lower part the vertical external walls 11*a* and 12*a* of the member 4 as well as the external partially vertical edges of the tongues 5 and the internal parts 5*a* of these tongues.

It will be appreciated that the embodiment which has just been described may be modified as to detail and certain components thereof replaced by equivalent components without thereby departing from the basic principles of the invention. In particular, as has already been pointed out, it is possible to use members having a single trough in which the pairs of stamped bosses 7*a*, 7*b* – 7*e*, 7*f* are replaced by tongues similar to the tongues 5 and positioned there-opposite. It is also possible to provide members in which the external vertical edges are cambered so as to facilitate their connection to other similar members or to a single channel inside module supports adapted to receive three or four parallel rows of male plugs.

It should be further noted that the bottom of the channel or channels of the shunt devices according to the present invention may be provided from point to point at the level of said elastic tongues with at least one riveting or screwing orifice when it is desired to provide either at least one supplementary electrical connection in the form of a socket or male plug with a conductor turned toward the lower part of these shunt devices or a coupling to a symmetrical connecting module, which may be obtained by joining these two modules side by side at their lower parts and electrically connecting their shunt means either directly or through a metallic connecting member.

What is claimed is:

1. Shunt device for making a direct electrical connection between a plurality of male plugs at the ends of electrical conductors, said device comprising an elongated metal strip formed from a single sheet of resilient metal and defining two parallel channels, each channel having a bottom, an internal wall adjacent the other channel, and an external wall more remote therefrom said internal walls being connected together along their upper ends and formed with a plurality of pairs of elongated parallel bosses transverse to the bottoms of said channels and projecting into said channels, said external walls being divided along lines transverse to said channel bottoms into a plurality of tongues parallel to said bosses, one tongue being positioned opposite each pair of bosses and acting as a spring to grip a plug inserted between that tongue and the pair of bosses thereopposite.

2. In combination, a shunt device as claimed in claim 1, at least one male electrical plug encircled by a locking collar, and at least one annular locking sleeve dimensioned to closely encircle said collar, said sleeve being provided with at least one inwardly projecting elastic tongue adapted to seat behind said collar when said sleeve encircles said collar, and said bosses being positioned to act as abutments against which said collar seats when said plug is inserted between a pair of bosses and the tongue on the external channel wall thereopposite.

3. Sealed module for effecting electrical connections comprising in combination a shunt device, a male plug and locking sleeve as claimed in claim 2, said locking sleeve being discrete from said shunt device, and an insulating member defining a seat for said shunt device and a plurality of partitions above said seat dividing said insulating member into a plurality of recesses, each shaped and dimensioned to receive a locking sleeve, and each being provided with a shoulder near the end of each partition remote from said shunt seat and engaging one end of said locking sleeve and spaced from the other end of said partition by a distance equal to the length of said sleeve.

* * * * *